United States Patent [19]

Klaren

[11] 4,119,139

[45] Oct. 10, 1978

[54] HEAT-EXCHANGER COMPRISING A SYSTEM OF GRANULATE CONTAINING VERTICAL TUBES, AND A METHOD FOR OPERATING THE SAME

[75] Inventor: Dick Gerrit Klaren, Hillegom, Netherlands

[73] Assignee: Gustav Adolf Pieper, Heemstede, Netherlands

[21] Appl. No.: 687,219

[22] Filed: May 17, 1976

[30] Foreign Application Priority Data

May 20, 1975 [NL] Netherlands ..... 7505870

[51] Int. Cl.[2] ..... F28G 13/00

[52] U.S. Cl. ..... 165/1; 134/109; 165/95; 165/104 F

[58] Field of Search ..... 165/1, 95, 104 F; 34/57 A; 134/109, 166 C, 169 C

[56] References Cited

U.S. PATENT DOCUMENTS

| | | | |
|---|---|---|---|
| 2,493,494 | 1/1950 | Martin | 165/95 X |
| 2,537,045 | 1/1951 | Garbo | 165/95 X |
| 2,684,124 | 7/1954 | Hines, Jr. | 34/57 A X |
| 2,934,551 | 4/1960 | Stringer | 165/104 F X |
| 3,066,017 | 11/1962 | Jahnig | 34/57 A X |
| 3,166,385 | 1/1965 | Pahlavouni | 34/57 A |
| 3,360,866 | 1/1968 | Shirai | 34/57 A X |
| 3,436,837 | 4/1969 | Abelow et al. | 34/57 A X |
| 3,507,319 | 4/1970 | Kogan | 165/95 X |
| 3,585,732 | 6/1971 | Itahashi | 34/57 A |

FOREIGN PATENT DOCUMENTS

| | | | |
|---|---|---|---|
| 968,920 | 9/1964 | United Kingdom | 165/95 |

*Primary Examiner*—Albert W. Davis, Jr.
*Attorney, Agent, or Firm*—Stevens, Davis, Miller & Mosher

[57] ABSTRACT

A method of heat exchange comprising flowing liquid heat-exchanging media upwardly as a stream containing fluidized particles onto some of which material is precipitated from the liquid thereby enlarging the particles, temporarily increasing the flow rate of the stream to fluidize the thus enlarged particles, expanding the stream to decrease the flow rate and permit settling out of a coarse fraction of particles and returning the stream to its original flow rate to readmit particles into the non-expanded stream.

5 Claims, 3 Drawing Figures

HEAT-EXCHANGER COMPRISING A SYSTEM OF GRANULATE CONTAINING VERTICAL TUBES, AND A METHOD FOR OPERATING THE SAME

The invention firstly relates to a method for operating a heat-exchanger of the type in which one of the heat-exchanging components flows as a liquid in a vertical upward direction through a system of granulate containing tubes, thereby keeping this granulate fluidised. A heat-exchanger of this type has been described in applicant's U.S. application Ser. No. 527,036 filed Nov. 25, 1974. By applying a fluidised granulated mass in the tubes a better heat-transfer is obtained thus lowering the costs of the used heat-exchanger by keeping the same capacity.

If a heat-exchanger is used for heating up the liquid in the tubes in which liquid substances are dissolved which have a reduced solvability at increased temperature, and therefore precipitate, this means an extremely undesirable reduction of the capacity of the heat-exchanger. For, if the precipitate forms on the wall of the tube, this tube-wall gradually grows closed, and furthermore the heat-transfer from the tube-wall gradually reduces. If the substance precipitates upon the granulate, (then) the grains of this granulate will also grow and sack down through the tubes, clog these tubes. In itself the use of a fluidised bed in a heat-exchanger of this type already is an advantage in view of the so called scale forming, because the precipitation of substance upon the tube-wall is reduced by it, or because the rubbing action of the granules on the tube-wall even tends to clean the latter. Generally speaking the use of a column of fluidised granulate allows somewhat higher liquid temperatures in the heat-exchanger than by using a conventional heat-exchanger. In this case is it necessary from time to time to renew the filling of the heat-exchanger tubes, as the granules then have obtained too great a growth. The invention aims at operating a heat-exchanger of the known type at higher possible temperatures, and thereby to fine a new, and very elegant method to avoid the undesired consequences of grain-growth.

The invention consists in that as a granulate a material is selected which preferably possesses a stronger tendency of growth with substances which precipitate from the liquid, than the wall of the tube, and in that periodically the heat-exchanger is shut off from the heat-exchanging media, whereupon the tubes are flushed sufficiently intensive in upward direction in order to have all the granulate transported into a chamber situated above the tubes, and to have it there at least partly, whereupon near the bottom of this chamber the coarsest fractions of the granulate are flushed in sideward direction from the chamber, whereupon by a decrease of the speed of flow through the tubes the remaining granulate, possibly after having been supplemented with finer fractions, is carried back into the tubes, and the process of heat-exchanging is continued.

It is of importance hereby that the granulate has a compositions and/or a shape and/or a crystallographic structure, which have a strong influence on increased scaleformation. It is hereby avoided that the tubewalls have to be cleaned periodically as well. Often such a granulate may be obtained by selecting its chemical composition in accordance with the substances with precipitate from the liquid. While flushing the granulate in the chamber the finest fractions will be drifted up most, whereas the coarsest fractions remain deposited or suspended near the bottom of the chamber. By opening the blow-off conduit near the bottom of the chamber it has been found to be possible to carry away the coarsest fractions without having a considerable quantity of finer material is carried along as well. In this way it is possible now to very quickly reduce the grainsize of the granulate inside the tubes without it being necessary to dismount and to empty the heat-exchanger. It is remarked that indeed the most obvious alternative consists in that the heat-exchanber is dismounted, the tubes are put upside down, which causes all granulate presently inside the tubes to fall out, whereupon the heat-exchanger, after having been put in the correct position again, is supplied with a new filling. Especially in connection with bigger heat-exchangers, which are part of for instance an expansion evaporator, this method would be prohibitive for the use of a fluidised granulate. It further has been found that supplementing with finer fractions and backfeeding of the granulate into the tubes may be performed very simple during the reduction of the speed of flow through the tubes. Thereupon also a certain mingling of the various grainfractions occurs.

Apart from the described method the invention also relates to a heat-exchanger consisting of a system, of granulate containing, vertical tubes which may be connected to a circuit of one of the heat-exchanging components, and in which these tubes with their upperends discharge into a chamber. The improved heat-exchanger thereby is characterised in that means are present to shut off the system of the tubes and the chamber of the said heat-exchanging circuit and to connect this system to a circuit for circulating a flushing liquid with a higher speed, in which near the bottom of the chamber, a disconnectable blow-off conduit connects. In a preferred embodiment of the invention a disconnectable supply conduit for fine granulate debouches into the top of the chamber.

A further improvement of the invention consists in that the chamber diverges from the debouching point of the tubes. It is hereby prevented that the finer grainfractions inside the chamber well up to intensely, and get into the flushing circuit.

A solution was found to be very favourable in which the granulated mass does not need to be flushed up as a whole. This may be reached if the granulate mass consists of two components which differ sufficiently in order that upon fluidisation a sharp separation is obtained between a lower and an upper layer.

The difference in composition of the granulate for both layers may be obtained by differences in specific mass of the used materials and/or a difference in grainsizes.

If the fluid flows through the fluidised upper layer in the tubes its temperature may have increased so much that substances which originally were dissolved in the liquid get a tendency to dissipate. By selecting a suitable material of the granulate in the upper layer it may be achieved that the originally dissolved substances in the liquid dissipate partly upon the granules which subsequently gradually grow, and by which the dissipation upon the tube-walls is reduced or even is prevented entirely.

If the granules in the lower layer, because of the selection of their composition, are inert for dissipation from the liquid, or if the raise in temperature of the liquid still is too little in order to realize dissipation of dissolved substances from the fluid, the granules in the lower layer will not grow.

Before the granules in the upper layer grow to a degree that the separation between both layers gets lost and mingling of the granulate from both layers may occur, it is desirable that the fluidised granulate in the upper layer is transported into the common chamber above the tubes at regular intervals by increasing the speed of flow of the liquid in the tubes, by which the coarsest fractions of the granulate in the upper layer remain near the bottom of the chamber, either deposited or floating. By opening the blow-off conduit near the bottom of the chamber it is possible to evacuate the coarsest fractions. In this way it is possible quickly to reduce the grainsize of the granulate in the upper layer, thus maintaining the separation between the upper layer and under layer while continuing of the operation under normal circumstances.

It is clear that if during normal operation the fluidised upper layer forms only part of the total height of both the fluidised under layer and the upper layer together the flow speed in the tubes is to be increased much less in order to transport only the granulated mass of the upper layer into the chamber above the tubes than in case the entire granulate mass is to be transported into the chamber above the tubes in order to separate the coarsest fraction through the blow-off conduit.

In this way it will be possible in many cases during normal operation to evacuate the grown granules in the upper layer and subsequently to replace them by finer grains, without the heat-exchanger having to be taken out of service and it having to be connected to a special circuit for pumping of a flushing liquid at increased speed.

Other objects and advantages of the invention will become apparent from the following description and accompanying drawings in which.

Figure 1:
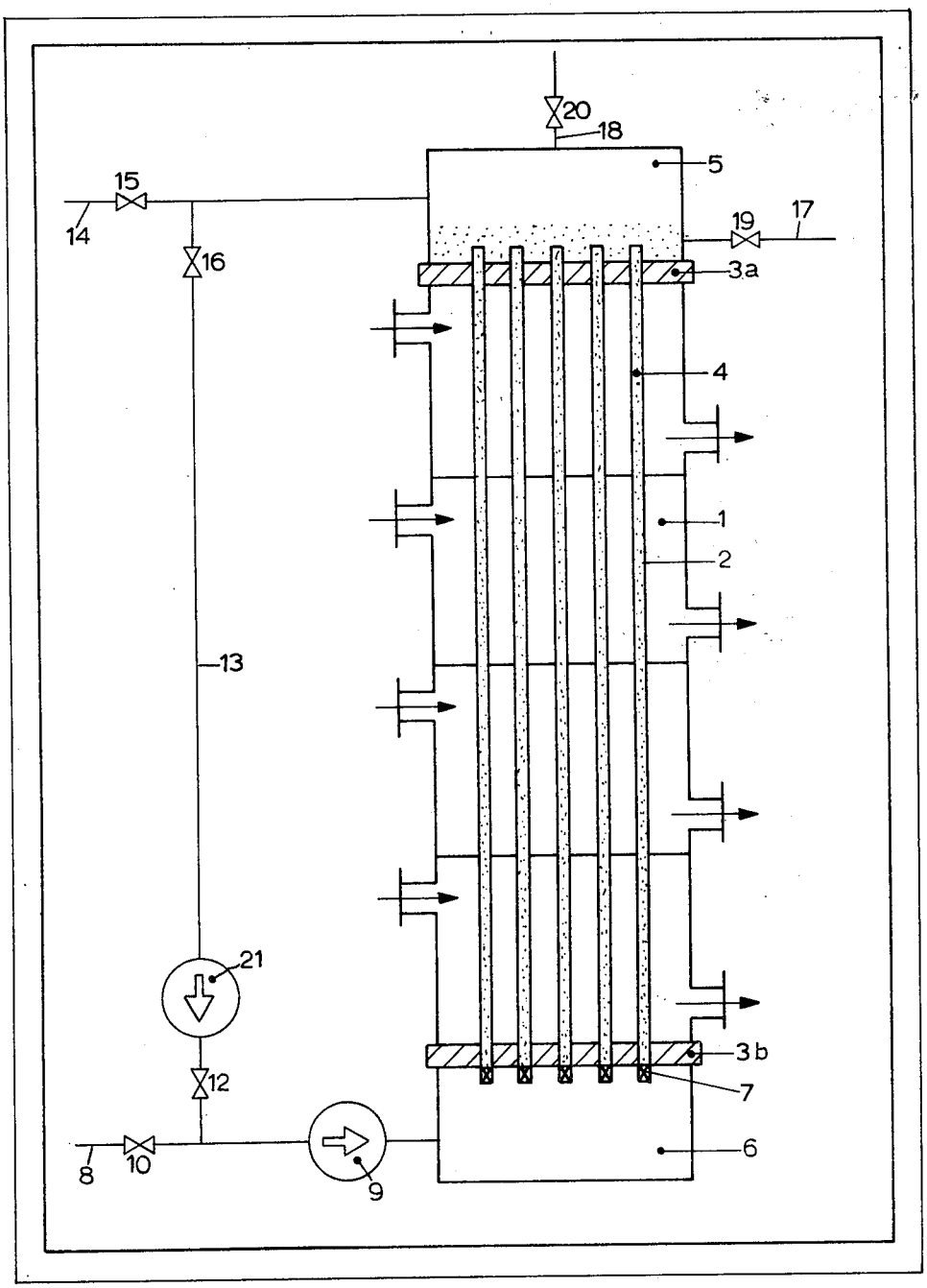
FIG. 1 shows one embodiment of the invention.

In FIG. 1 an embodiment of the heat-exchanger according to the invention is demonstrated schematically, in which a granulate mass is used having only single composition and the granules are subject to grow as a consequence of a possible dissipation from the liquid.

The heat-exchanger consists of four compartments 1 in which heat is transferred upon a liquid which flows through tubes 2 in upward direction. Tubes 2 are fixed between two tube plates 3*a* and 3*b*. Although in the figure four heat exchanging compartments 1 are shown, it will be clear that the number of these compartments is not essential for the principle of the invention. The tubes 2 debouch into a chamber of outletbox 5. At the bottom-side of the tubes 2 an inletbox 6 is provided from which liquid is carried through narrow openings into the tubes 2. Inside the tubes 2 a granulate 4 is provided, which during operation is fluidised by the upward flowing liquid, and thereby expands into the outletbox 5. The narrow inlet openings 7 prevent the escape of granulate into the inletbox 6.

During normal operation the liquid to be heated is supplied to the heat-exchanger through conduit 8 and through valve 10 and pump 9. The discharge of the heated liquid takes place through conduit 14 through the opened valve 15. The circuit further includes a circulating conduit 13 with in it a pump 21 and valves 12 and 16. During normal operation valves 12 and 16 are shut and pump 21 is not functioning. Also near the bottom of the outletbox 5 a blow-off conduit 17 connects with in it a valve 19, whereas in the top of the outletbox 5 a supply-conduit 18, also with a valve 20, debouches. During normal operation valves 19 and 20 are shut too.

If after some time the average grainsize has increased to such an extent that the operation of the heat-exchanger deteriorates, which may be deducted from a decreasing temperature of the liquid discharged through conduit 14, measures are to be taken in order to convey the most severly grown grains from the heat-exchanger and to supply the filling with smaller grains. Thereto first of all valves 10 and 15 are shut and valves 12 and 16 are opened. The flow of the heat transferring medium, which flows transfers to the tubes through the compartments 1, may be shut off, however whether or not this is necessary will have to be determined from case to case considering the circumstances. After pump 21 has been put into operation, whereas pump 9 remains operating, the liquid which is present inside the heat-exchanger is circulated through the circulating circuit with such an increased speed, that all granulate present in the tubes 2 is forced into the outletbox 5. It thereby is advisable to increase the speed of flow sufficiently in order that the medium sized and the smaller grains in the top of outletbox 5 start suspending, whereas the bigger grains remain near the bottom of outletbox 5. If thereupon valve 19 is opened the part of the flow of circulating liquid having a relatively reduced speed, will discharge mainly only the course of grains out of the system through blow-off conduit. Then valve 19 is closed again.

Simultaneously with the blowing off, or shifted in phase therewith, valve 20 may be opened, allowing finer grains of the granulate to be fed into the system. If this happens, the speedflow of the circulating liquid may, either by reducing the speed of pump 21, or by gradually closing one or more of the valves 12 or 16, be reduced gradually, which causes the granulate to fall back into tubes 2 again. The heat-exchanger thereupon is suitable for normal operation again, whereupon pump 21 is shut off, valves 12 and 16 are closed, and valves 10 and 15 are opened.

Various variations of the described system are possible. For instance instead of only one blow-off conduit. A number of blow-off conduits 17 may be connected around the outletbox 5. Also for instance pump 21 is not necessary, if pump 9 has the required capacity effect the circulation. with the necessary speeds.

Figure 2:
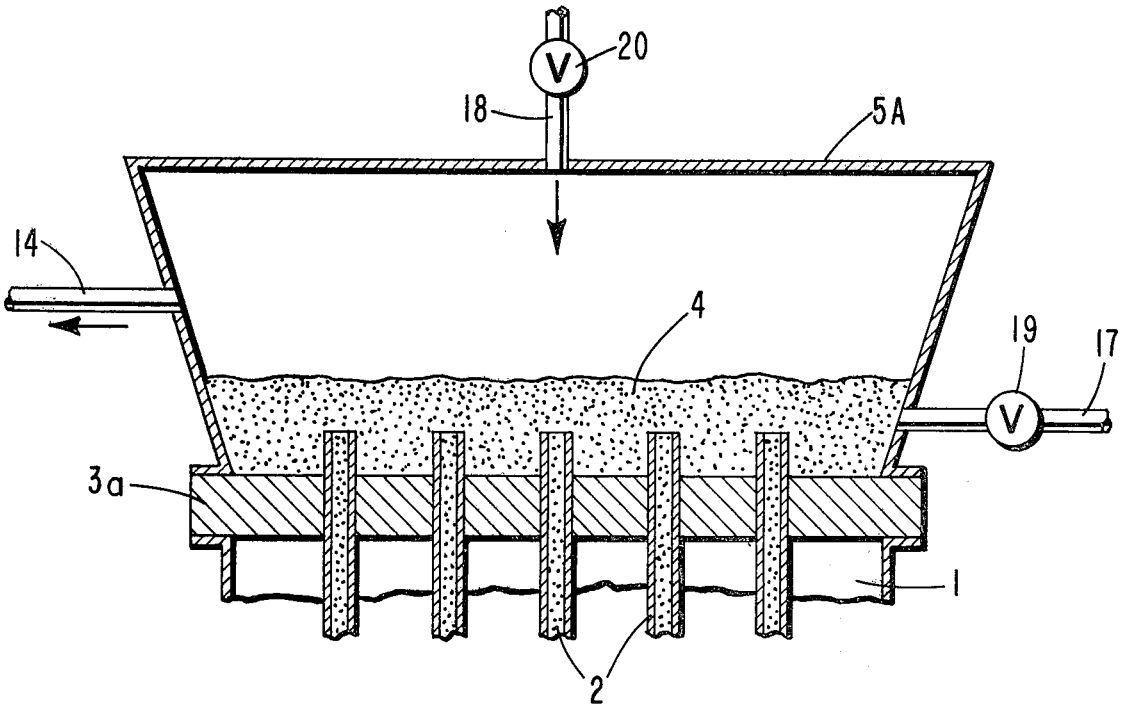
FIG. 2 shows a second embodiment of the invention.
Figure 3:
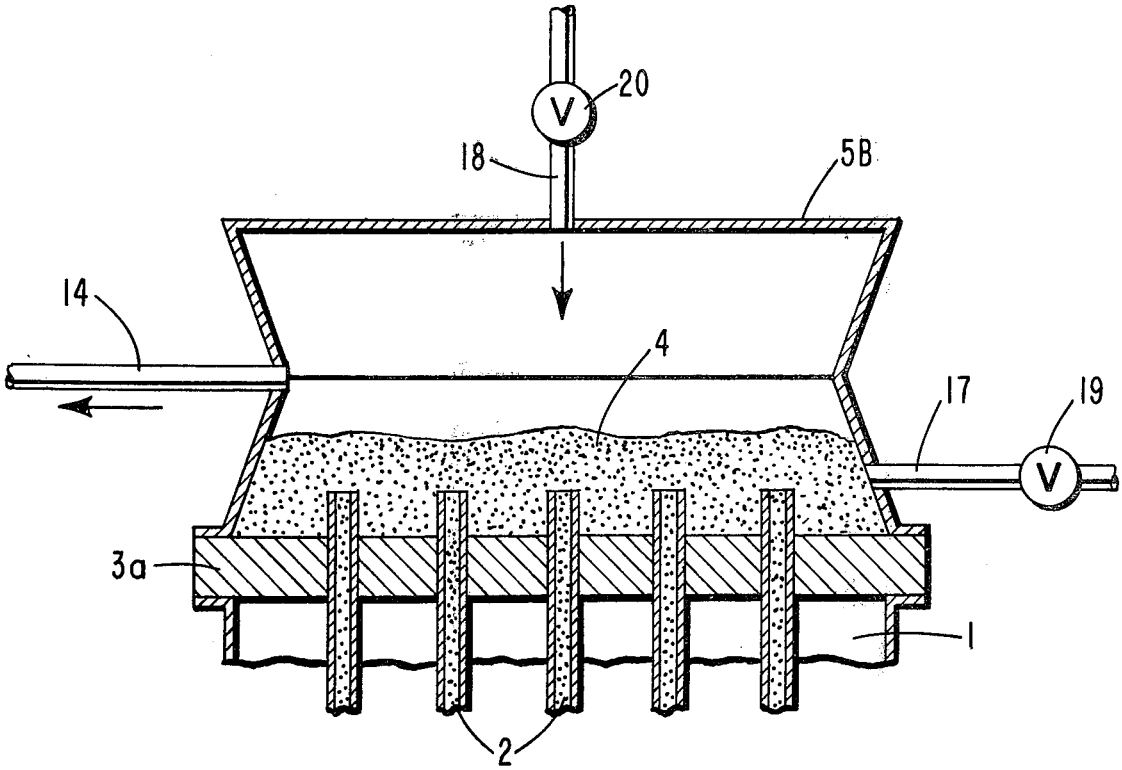
FIG. 3 shows a third embodiment of the invention.

Often further improvements may be obtained by shaping outletbox 5 convergent. This provides for obtaining a better separation of the floating finer and medium fine grainmaterial and the coarser material which remains near the bottom. If, however, the risk is feared that the finer material is carried along from the outletbox 5 into the outlet conduit 14, or in the circulating conduit 13 respectively, it is also possible to shape the exitbox 5A divergent (FIG. 2). Thereby the speed in the top section of the box is sufficiently reduced to let also the finest material fall down there. Also combinations of conical or stepped converging and diverging walls 5B of the flow chambers are possible (FIG. 3).

If a granulate mass is used having two different compositions, of which mass in fluidised condition the upper layer is subject to growth, this may lead to the consequence that the pass by conduit 13 with the pump 21 and the valves 12 and 16 become superfluous as the relatively restricted increase of the flow through speed in the tubes, which is necessary in this case to transport the upper layer of the granulate mass into the box 5, may easily be obtained by using pump 9 in combination with an adjustment of valves 8 and/or 14. The blowing-off of the coarsest granule fractions from the granulate in the upper layer also in this case is done through conduit 17 and valve 19, whereas the supplementing of fine material occurs through conduit 18 and valve 20.

I claim:

1. A method of heat exchange comprising flowing liquid heat-exchanging media upwardly as a stream, said stream containing fluidized particles onto some of which material is precipitated from the liquid thereby enlarging the particles, temporarily increasing the flow rate of the stream to fluidize the thus enlarged particles, expanding the stream to decrease the flow rate and permit settling out of a coarse fraction of particles and returning the stream to its original flow rate to readmit particles into the non-expanded stream.

2. The method according to claim 1 wherein said removal of a coarse fraction of particles is performed periodically and additional particles are added to said stream to replace the coarse fractions removed.

3. The method according to claim 1 wherein the said coarse fraction is removed by permitting a lateral outflow from said expanded stream.

4. The method according to claim 1 wherein substantially all of the particles are simultaneously flushed into said expanded stream for removal of enlarged particles.

5. The method according to claim 1 wherein the particles comprise two component portions which when fluidized respectively form an upper layer and a lower layer, the upper layer being flushable into said expanded stream while the lower layer substantially remains in non-expanded portion of said stream.

* * * * *